United States Patent [19]

Rabe

[11] Patent Number: 4,654,943

[45] Date of Patent: Apr. 7, 1987

[54] TUBE POSITIONING TOOL AND METHOD FOR USE

[75] Inventor: George B. Rabe, Sparta, N.J.

[73] Assignee: Foster Wheeler Energy Corporation, Livingston, N.J.

[21] Appl. No.: 833,624

[22] Filed: Feb. 24, 1986

[51] Int. Cl.[4] ..... B21D 53/00; B23P 15/26; B23P 19/04

[52] U.S. Cl. ..... 29/157.4; 29/255; 29/523; 29/727

[58] Field of Search ..... 29/157.4, 421 R, 801, 29/255, 282, 523, 522 R, 726, 727

[56] References Cited

U.S. PATENT DOCUMENTS

| | | | |
|---|---|---|---|
| 4,387,507 | 6/1983 | Kelly | 29/157.4 |
| 4,414,739 | 11/1983 | Kelly | 29/157.4 |
| 4,445,261 | 5/1984 | Kelly | 29/157.4 |
| 4,607,426 | 8/1986 | Kelly | 29/157.4 |

*Primary Examiner*—Howard N. Goldberg

*Assistant Examiner*—Irene Graves Golabi

*Attorney, Agent, or Firm*—Marvin A. Naigur; John E. Wilson; Martin Smolowitz

[57] ABSTRACT

A tube positioning tool for remotely positioning a replacement tube into axial alignment and interfitting engagement with an existing tube, and method for its use. The forward end section of the elongated pressurizable tube positioning tool is first inserted through the replacement tube and into the existing tube end, after which the forward end is clamped into position therein by pressurizing the tool and expanding the tool nose end. Next, the tool body rear piston is pressurized and the replacement tube is moved forward into axial alignment and interfitting engagement with the adjacent existing tube. Then the tool body front piston is pressurized to expand a resilient mandrel and the rear portion of the replacement tube is expanded firmly into the opening in the tube sheet. Following such replacement tube installation, the tool is depressured and withdrawn from the tubes.

12 Claims, 2 Drawing Figures

TUBE POSITIONING TOOL AND METHOD FOR USE

BACKGROUND OF INVENTION

This invention pertains to a tube positioning tool and method for its use. It pertains particularly to an elongated hydraulically-operated tool device useful for remotely axially positioning a tube in interfitting engagement with an existing tube, and to a method for using the tube positioning tool for remotely aligning and positioning a replacement tube.

In steam generators such as used for nuclear power plants, bundles of U-shaped heat exchange tubes are usually welded into a relatively thick tube sheet. During operation of such steam generators over an extended period of time, such as 10 years or more, a corrosive sludge material forms and accumulates on the inner upper surface of the tube sheet. This accumulated sludge material causes corrosion of the tube to an extent of potential or actual tube failure. To correct this serious problem without the undesired replacement of the heat exchanger, it is necessary to remove the old deteriorated tube end portions from the tube sheet and replace them with new tube portions which are remotely positioned and welded pressure tightly into place, without removing and dismantling the entire heat exchanger assembly. However, because of the remote relatively inaccessible location of the tubes and the radioactive environment which is usually involved, such tube replacement is very difficult to accomplish reliably and safely. Thus, a suitable solution to this problem has been needed, particularly for heat exchangers used in the nuclear power industry.

Some tools for tube alignment have been previously developed in the prior art. For example, a simple tube alignment device is disclosed by U.S. Pat. No. 914,743 to McDonald. Another tube alignment device is disclosed by U.S. Pat No. 2,429,053 to Forbes for end alignment of adjacent pipes prior to butt welding them together, and also by U.S. Pat. No. 2,730,604 to Eberle et al. U.S. Pat. No. 2,767,677 to Johnson et al discloses a jig for alignment of slip-on flanges on a pipe prior to welding them in place. However, none of these prior art devices has been found suitable for remotely axially positioning a tube portion in axial alignment and engagement with an existing tube, using hydraulic pressure. Accordingly, the present invention provides a special tube positioning tool which, after remote removal of damaged tubes from a heat exchanger, provides for their remote replacement with a new tube suitably aligned and inserted into the existing tube, and provides a method for using the tube positioning tool of the present invention to accomplish such remote tube alignment and positioning.

SUMMARY OF INVENTION

The present invention provides a tube positioning tool device useful for remotely positioning a replacement tube in axial alignment and interfitting engagement with an adjacent end of an existing tube. The invention also provides a method for using the tube positioning tool for remotely axially aligning a replacement tube with an existing tube, then axially moving the replacement tube forward into axial interfitting engagement with the existing tube, followed by radially expanding the replacement tube firmly into a tube sheet.

The tube positioning tool comprises a main body part having a cylindrical bore therein and dual pressure connections to said bore, and having a centrally located divider fixed in the bore between the dual pressure connections. A rear piston means having a pressure connection is provided slidable partially within the rear portion of the bore in the main body part, the piston having an elongated inner tube unit extending forwardly through the piston and main body part and being attached at the tube opposite end to a tapered nosepiece. A clamp body slidably fits over the elongated inner tube unit, and is rigidly attached at its forward end to an expansion collet having multiple resiliently supported jaws. An annular shaped piston is provided attached to the inner tube unit and slidable within the clamp body, so that by pressurizing the piston the tube unit is moved rearwardly so that the collet resilient jaws are moved radially outwardly by axial rearward movement of the tapered nosepiece member relative to the collet jaws. Thus, the nosepiece can be drawn rearward into the collet clamp by the application of fluid pressure to the inner tube annular piston actuator associated with the tool front portion. The fluid pressure is supplied to the annular piston through the inner tube, which in turn is pressurized through a port connected to the rear piston.

Pressure applied to the main body rear port between the rear piston and the divider will force the main body to move forward relative to the rear piston, which action also moves the replacement tube forward into an axial interfitting relationship with the existing tube. Located at the front portion of the main body is a front piston connected to a collar and enclosing an expandable mandrel all slidable relative to the inner tube unit, and adapted for contacting the inner wall of the replacement tube and expanding it radially into a tube sheet.

In the operation or use of the tube positioning tool, the tool forward end is first inserted through a replacement tube and into an adjacent end of an existing tube. Then the tool clamp actuator piston is pressurized through the pressure connection in the rear piston. Fluid pressure is provided from an external source, and the clamp actuator piston is moved axially rearwardly to draw the tapered nosepiece into the collet and expand the collet, and thereby anchor the tool forward end firmly into the existing tube. Next, the main body rear pressure connection is pressurized thereby forcing the main body and the accompanying replacement tube axially forward into an interfitting engagement with the adjacent existing tube end. Then, the main body forward pressure connection is pressurized to expand the resilient mandrel against the replacement tube inner wall and to expand the tube into a tube sheet. After the tube positioning tool is thereby pressure actuated, the fluid pressure at all three ports is released. The tube positioning tool is then withdrawn from the tube and tube sheet.

The tube positioning tool in accordance with the present invention is particularly useful for the remote replacement of deteriorated tube end portions adjacent a tube sheet in heat exchangers of steam generators in nuclear power plants, by remotely positioning a replacement tube in interfitting relationship with an existing tube end ready for subsequent welding the tubes together. The tool enables such tube end portions to be advantageously replaced safely and reliably with minimal modification to the exchanger and substantially reduced outage time for the plant.

BRIEF DESCRIPTION OF DRAWINGS

This invention will be described by reference to the following drawings, in which.

DESCRIPTION OF INVENTION

Figure 1:
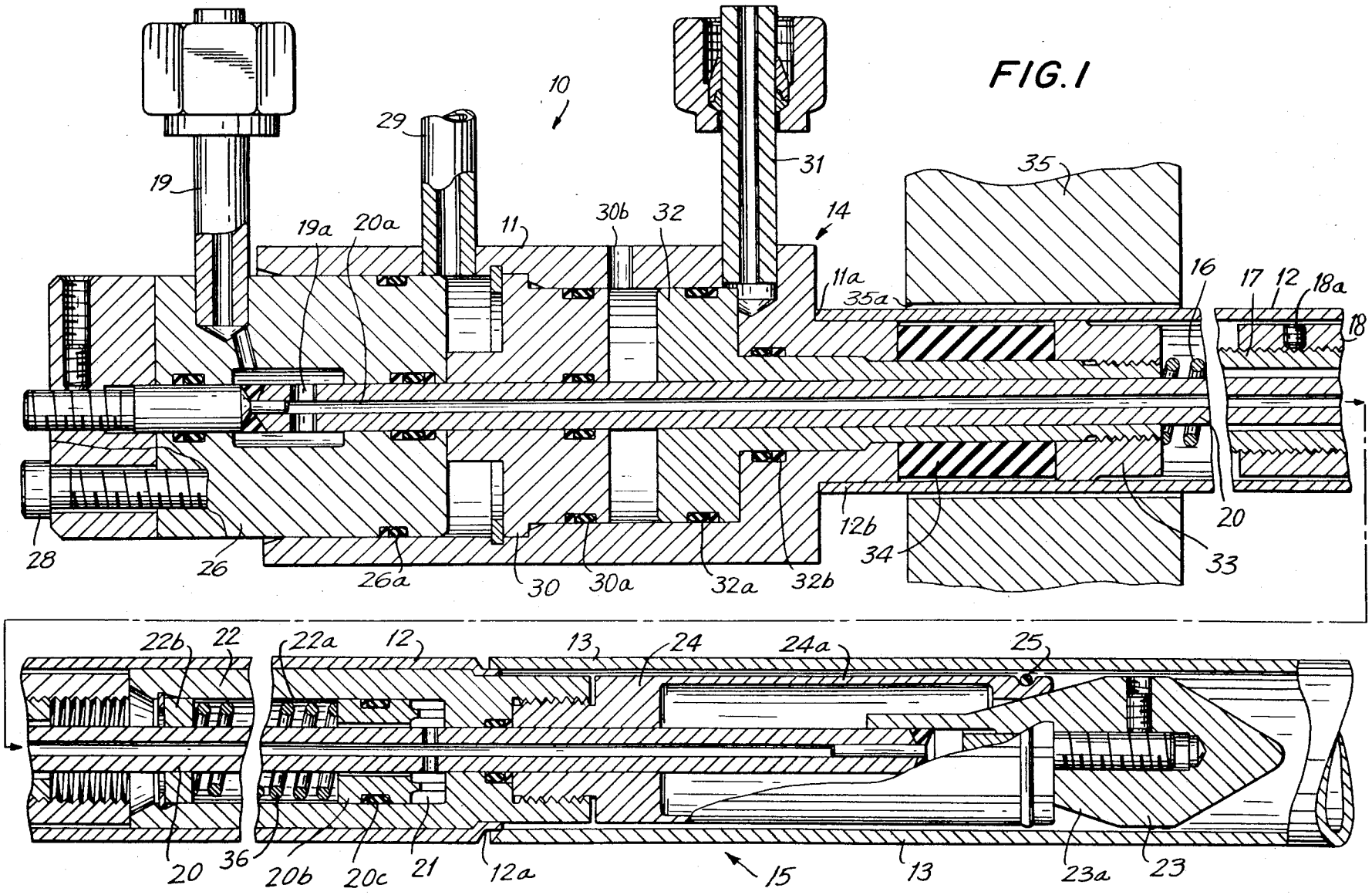
FIG. 1 shows a longitudinal cross sectional view of the tube positioning tool inserted into a replacement tube and existing tube end according to the present invention.

The tube positioning tool device of the present invention will now be described according to a preferred embodiment with reference first to FIG. 1, which shows a longitudinal cross-sectional view of the tube positioning tool IO after being inserted into position in a replacement tube 12 and an existing tube end 13, but with the functional parts of the tool in normal position and not yet pressure actuated. As shown in FIG. 1, the elongated tool 10 includes two principal sections. The tool 10 includes a rear section 14 having three pressure connections and a reduced diameter front section 15, which is inserted through the replacement tube 12 and into existing tube end 13.

The main body part 11 is the principal component of the tool rear section 14, and contains two pistons each slidable within a cylindrical bore and each having a pressurizing port connected to the body and separated by a centrally located divider wall 30 sealably fixed within the bore of the body 11. The tool front section 15 is separated from the rear section 14 by substantially the length of the replacement tube 12. The two sections 14 and 15 are connected together by an inner tube unit 20, and are held in their proper relative positions by a central spring 16 which surrounds inner tube unit 20. Spring 16 acts against a guide tube 17 and an annular shaped adjusting nut 18 which also surround the inner tube unit 20, and are locked to guide tube 17 by a set screw 18*a*.

The tool front section 15 includes a cylindrical clamp body 22 threadably attached at its forward end to a collet clamp 24, which both surround and are slidable on the inner tube unit 20. The inner tube 20 connects tapered nosepiece 23 to a rear piston 26 having seal ring 26*a* and slidable in main body 11, and extends through the rear piston 26. Rear pressure port 19 is connected to the rear piston 26, so that fluid pressure from port 19 can be transferred through radial openings 19*a* to passageway 20*a* in the tube unit 20. The rear end of the inner tube unit 20 is threaded into a locking plate 27, which is fastened to the rear piston 26 by screws 28. The locking plate 27 has lock screw 27*a* and permits the final length of the tool 10 to be set to match that of the replacement tube 12. Seal rings are provided around tube unit 20 as needed in rear piston 26, divider 30, and clamp body 22 to confine the pressure from port 19 to passageway 20*a*.

The collet clamp 24 is fluid pressure actuated through tube unit 20, and is used to temporarily clamp the tool 10 forward end 15 firmly against the inner surface of the existing tube 13. Whenever fluid pressure is applied at the rear pressure port 19 attached to the rear piston 26, the pressure passes through the central passage 20*a* of inner tube unit 20 to a cavity 21 located between an annular actuator piston 20*b* and the bore 22*a* of clamp body 22 Piston 20*b* having seal ring 20*c* is attached to tube 20 and are both slidable within the clamp body 22. Pressurizing cavity 21 forces the inner tube actuator piston 20*b* and attached tube unit 20 rearward against spring 36 anchored to clamp body 22 at ring 22*b*, and tends to force the clamp body 22 forward. This action causes the tapered surface 23*a* of nosepiece 23, which is threadably attached to tube unit 20, to be drawn rearwardly into expandable collet clamp 24, thereby spreading multiple collet fingers 24*a* and forcing them into firm contact within the existing tube 13. Also, an "O" ring 25 is provided surrounding the forward end of collet 24 to advantageously increase the friction between the collet clamp 24 and the existing tube 13.

Figure 2:
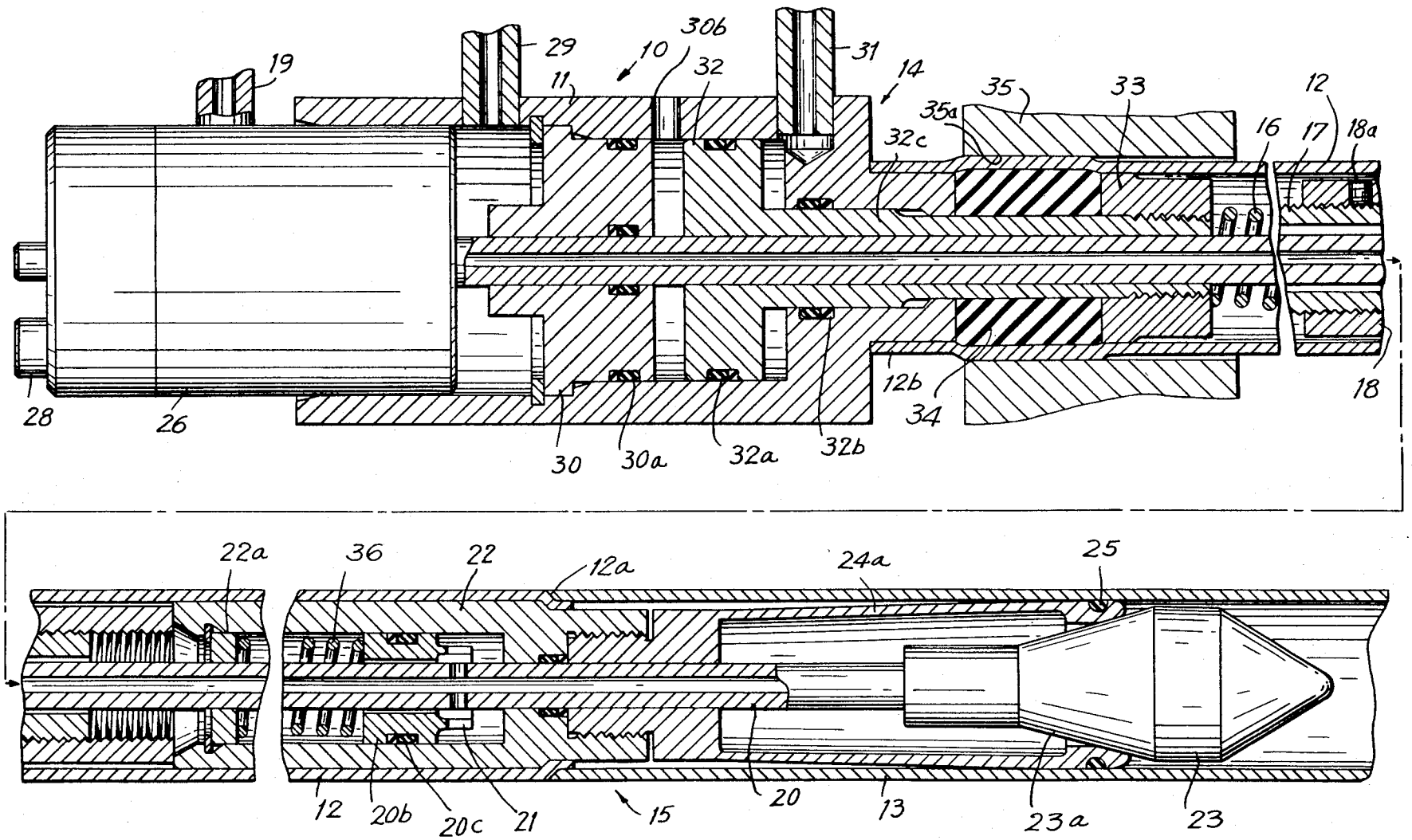
FIG. 2 is a partial longitudinal cross-sectional view of the tool after its parts have actuated by fluid pressure.

After the tool 10 forward end collet clamp 24 has been clamped, firmly into the existing tube 13, the fluid pressure from rear port 19 also forces the forward end of clamp body 22 against the forward formed end 12*a* of the replacement tube 12, and moves it forward into an interfitting engagement with the existing tube 13, as shown in FIG. 2. Also, the intermediate port 29 connected to main body 11 is now pressurized. This provides fluid pressure against the divider plate 30 containing seal ring 30*a* and forces it forward together with the attached main body 11, so that the main body is thereby moved forward against the replacement tube rear end 12*b*, thereby providing an additional axial force for moving the forward end 12*a* of replacement tube 12 into axial interfitting engagement with the end of existing tube 13. Any fluid leakage past seal ring 30*a* is drained from body part 11 at relief opening 30*b*.

Following the axial engagement of front end 12*a* of replacement tube 12 into interfitting relationship with tube 13, the main body front pressure port 31 is next pressurized, which forces the expander piston 32 having seal rings 32*a* and 32*b* rearward. Any fluid leakage past seal ring 32*a* is removed at opening 30*b*. Piston 32 has sleeve portion 32*c* attached to retainer 33, so that fluid pressurization at port 31 also causes retainer 33 to move rearward towards forward end 11*a* of body 11 and thereby compress expandable resilient mandrel 34 located between the retainer 33 and main body 11. This compressive action causes the resilient mandrel 34 to expand radially outwardly against the replacement tube 12 inside diameter, and expands the tube into firm engagement with the tube sheet 35, as is shown in FIG. 2. Thus, FIG. 2 shows a longitudinal cross-sectional view of the tube positioning tool 10 after all three pressurized functions of the tool have been actuated.

After the tool has been thus fully actuated to force the replacement tube 12 into interfitting relationship with tube 13 and to expand tube 12 firmly into tube sheet 35, as is shown in FIG. 2, the fluid pressure at each port is then released. By releasing the fluid pressure at the three ports 19, 29 and 31, the movable parts of tool 10 will return to their original positions as shown in FIG. 1 by action of the springs 16 and 36. Spring 36 will cause the inner tube unit 20 and piston 20*b* to return to their original positions relative to clamp body 22 and disengage collet 24 from tube 13 inner wall. Also, the natural resiliency of the expandable mandrel 34 will move the expander piston 32 forward to its original position in main body 11.

In operation or use of the tube positioning tool 10, a replacement tube 12 is first placed in position on the tool 10 forward end section 15. The tool and tube assembly is then pushed through a hole 35*a* in a tube sheet 35 until the tool forward end portion 15 is in place within the existing tube 13, as is shown in FIG. 1. Pressurizing rear port 19 causes the tool 10 forward end collet 24 to be clamped into the existing tube 13, and also forces the formed end 12*a* of the replacement tube 12 into partial axial engagement with the existing tube 13, as is shown in FIG. 2. Intermediate port 29 is then pressurized, thereby causing an axial force to be exerted by body front surface 11*a* on the replacement tube 12 relative to the existing tube 13, and moves tube 12 axially forward into interfitting engagement with the tube 13. Then, pressurizing the front port 31 moves piston 32 rearward and causes the rear end of replacement tube 12 to be expanded firmly into the hole 35*a* in the tube sheet 35, thereby firmly holding tube 12 in place.

The pressure is next released at all ports 19, 29 and 31, and the moving parts of tool 10 return to their original positions. The tool is then withdrawn from the tubes 12 and 13, leaving the replacement tube 12 firmly anchored in place within the tube 13 and the tube sheet 35.

Although this invention has been described broadly and in terms of a preferred embodiment, it will be understood that modification and variations can be made and some features used without others all within the scope of the invention, which is defined by the following claims.

I claim:

1. A tool device for remotely positioning a replacement tube in axial alignment engagement with an existing tube, comprising:

(a) a main body having a cylindrical bore therein and containing dual connections spaced apart longitudinally and extending into said bore, and a divider provided within said bore between said dual connections;

(b) a rear piston means slidably interfitting partially within the rear portion of said bore in said main body, said rear piston having a pressure connection and an elongated inner tube unit attached thereto, said inner tube unit extending forwardly through the divider and main body and being rigidly connected at its forward end to a tapered nosepiece;

(c) a forward piston means slidably located within said body bore and slidably enclosing said elongated inner tube unit, said forward piston having a retainer collar attached thereto and enclosing a resilient clamping mandrel located between the main body forward end and said retainer; and (d) a clamp body provided at the forward end of said main body and slidably fitted over said inner tube unit, said clamp body being attached at its forward end to a collet clamp located between said clamp body and said tapered nosepiece, whereby said clamp body and collet can be inserted into a replacement tube for axially moving the replacement tube forward toward said annular collet clamp means when anchored in an existing tube.

2. A tube positioning tool according to claim 1, wherein a central spring is provided between said retainer and the tool forward section.

3. A tube positioning tool according to claim 1, wherein said intermediate clamp body has an annular actuator piston slidable therein, said piston being attached to said inner tube unit.

4. A tube positioning tool according to claim 1, wherein said intermediate clamp body has reduced diameter at its forward end to mate with the forward end of a replacement tube.

5. A tube positioning tool according to claim 1, wherein said inner tube clamping means comprises an annular collet having radially expandable fingers and nosepiece centrally located therein.

6. A tube positioning tool according to claim 1, wherein said rear piston has larger diameter than said forward piston slidable within the main body.

7. A tube positioning tool according to claim 3, wherein axial spring means are provided within said clamp body to move said nosepiece axially forward to release the collet clamping against the existing tube inner wall.

8. An elongated tool for remotely positioning a replacement tube in axial alignment and interfitting engagement with an existing adjacent tube, comprising:

(a) a main body having a cylindrical bore therein and containing dual pressure connections spaced apart longitudinally and opening into said bore, and a divider rigidly provided within said bore intermediate said dual connections;

(b) a rear piston means slidably interfitting partially within the rear portion of said bore in said main body, said rear piston having a pressure connection and an elongated inner tube unit attached thereto, said inner tube unit extending forwardly through the divider and main body and being rigidly connected at its forward end to a tapered nosepiece;

(c) a forward piston means slidably provided within said body bore and slidably enclosing said elongated inner tube unit, said forward piston having a retainer collar attached thereto and enclosing a resilient clamping namdrel located between the main body forward end and said retainer collar; and (d) a clamp body provided at the forward end of said main body and slidably fitted over said inner tube unit, said clamp body including an annular actuator piston slidable therein and being attached at its forward end to an annular collet clamp means located between said clamp body and said tapered nosepiece, whereby said clamp body and collet can be inserted into a replacement tube for axially moving the replacement tube forward toward said annular collet clamp means when anchored in an existing tube.

9. A method for remotely positioning a replacement tube in axial alignment and interfitting engagement with an adjacent existing tube, comprising:

(a) inserting a front end section of an elongated positioning tool through the replacement tube and into the existing tube;

(b) pressurizing an inner tube of said tool and withdrawing a nosepiece into a concentric tube clamp and thereby expanding the clamp to contact the existing tube inner wall and clamp the tool front end section to the existing tube:

(c) pressurizing a rear piston means in the tool body to move the body and replacement tube forward into axial engagement with the existing tube end; and (d) pressurizing the positioning tool forward piston to clamp a resilient mandrel of the tool against the inner cylindrical surface of the replacement tube to radially expand the replacement tube into a surrounding tube sheet.

10. A tube replacement method according to claim 9, wherein clamping said nosepiece to the existing tube is released by axial movement of the nosepiece by spring means.

11. A tube replacement method according to claim 9, wherein the pressurizing of the tool is provided by externally supplied hydraulic pressure at 500–2000 psig pressure.

12. A method for remotely positioning a replacement tube portion in axial alignment and interfitting engagement with an adjacent existing tube, comprising the steps of:

(a) inserting a front end section of an elongated positioning tool through the replacement tube and into the existing tube;

(b) pressurizing an inner tube of said tool to 500–2000 psig and withdrawing a nosepiece into a concentric tube collet clamp and thereby expanding the collet clamp to contact the existing tube inner wall;

(c) pressurizing a rear piston means in the tool body to 500–2000 psig and moving the replacement tube axially forward into axial engagement with the end of the existing tube;

(d) pressurizing the tool forward piston to 500–2000 psig pressure to clamp the tool resilient mandrel firmly against the inner surface of the replacement tube and thereby expand the replacement tube into a tube sheet; and (e) releasing the pressure at the inner tube and the body pistons and withdrawing the tool from the tubes.

* * * * *